US009595246B2

(12) United States Patent
Hagstrom

(10) Patent No.: US 9,595,246 B2
(45) Date of Patent: Mar. 14, 2017

(54) ADJUSTABLE BRASS VALVE

(71) Applicant: John Hagstrom, Chicago, IL (US)

(72) Inventor: John Hagstrom, Chicago, IL (US)

( * ) Notice: Subject to any disclaimer, the term of this patent is extended or adjusted under 35 U.S.C. 154(b) by 13 days.

(21) Appl. No.: 14/643,847

(22) Filed: Mar. 10, 2015

(65) Prior Publication Data

US 2016/0267891 A1 Sep. 15, 2016

(51) Int. Cl.
*G10D 9/04* (2006.01)
*G10D 7/10* (2006.01)

(52) U.S. Cl.
CPC ..... *G10D 9/04* (2013.01); *G10D 7/10* (2013.01)

(58) Field of Classification Search
CPC G10D 9/00; G10D 9/043; G10D 7/00; G10D 9/04; G10D 13/026; G10G 5/00; A01M 31/004
USPC ..... 84/394, 387 A, 380 R
See application file for complete search history.

(56) References Cited

U.S. PATENT DOCUMENTS 3,990,342 A * 11/1976 Reeves ..... G10D 9/04 84/392
7,667,117 B2 * 2/2010 Wasser ..... G10D 9/04 84/144

* cited by examiner

*Primary Examiner* — Kimberly Lockett
(74) *Attorney, Agent, or Firm* — Kilpatrick Townsend & Stockton LLP

(57) ABSTRACT

An adjustable valve for a musical instrument, such as a trumpet, allows valve alignment to be adjusted without removing the valve from the instrument. The adjustable valve fits and looks like a standard valve. Rotation of a finger button of the valve causes an upper portion of an adjustable stem to rotate with respect to a lower portion of the adjustable stem that is threadably coupled to the upper portion, resulting in control over the length of the adjustable stem. Increasing or decreasing the length of the adjustable stem changes the alignment of the valve piston within the valve tube. Control over piston alignment is achieved by rotating the finger button, and thus is achieved without the need to remove the valve from the instrument.

20 Claims, 7 Drawing Sheets

ADJUSTABLE BRASS VALVE

TECHNICAL FIELD

The present disclosure relates to musical instrument valves generally and more specifically to adjustable valves for trumpets and other valve-based instruments.

BACKGROUND

In musical instruments, specifically in the category of instruments known as brass instruments, air is directed through a tubing path in order to produce fundamental pitches. For many instruments, valves are located in the tubing path, which when actuated, direct air through alternate paths of tubing, or crooks, before allowing the air to be directed back through the main path. Use of these valves allows the musician to quickly change the overall length of the tubing path, thus allowing the musician to quickly change the fundamental pitch of the instrument.

Each valve contains multiple openings that can be aligned with openings in the main tubing path and alternate tubing paths. By applying pressure to a valve's finger button, the valve's piston will be displaced and the openings in the valve are moved to a desired position. For example, when the valve is not actuated, air may pass from the main tubing path, through a first set of openings, and continue through the remainder of the main tubing path. However, when a valve's finger button is depressed, the valve can be moved so that air passing from the main tubing path into the valve will pass into a second set of openings, continue through an alternate tubing path, and then back into the valve and out through the remainder of the main tubing path.

Variations in alignment between the openings of the valve and the openings of the main tubing path and alternate tubing paths can cause effects in the sound produced by the instrument, the amount of backpressure experienced by a musician, and other effects. Misaligned valves can result in a change of clarity of the sound, a change in the sound of how a note begins or ends, a change in the energy of the sound, change in waveform reflections within the instruments, as well as other changes.

BRIEF DESCRIPTION OF THE DRAWINGS

The specification makes reference to the following appended figures, in which use of like reference numerals in different figures is intended to illustrate like or analogous components

DETAILED DESCRIPTION

Figure 1:
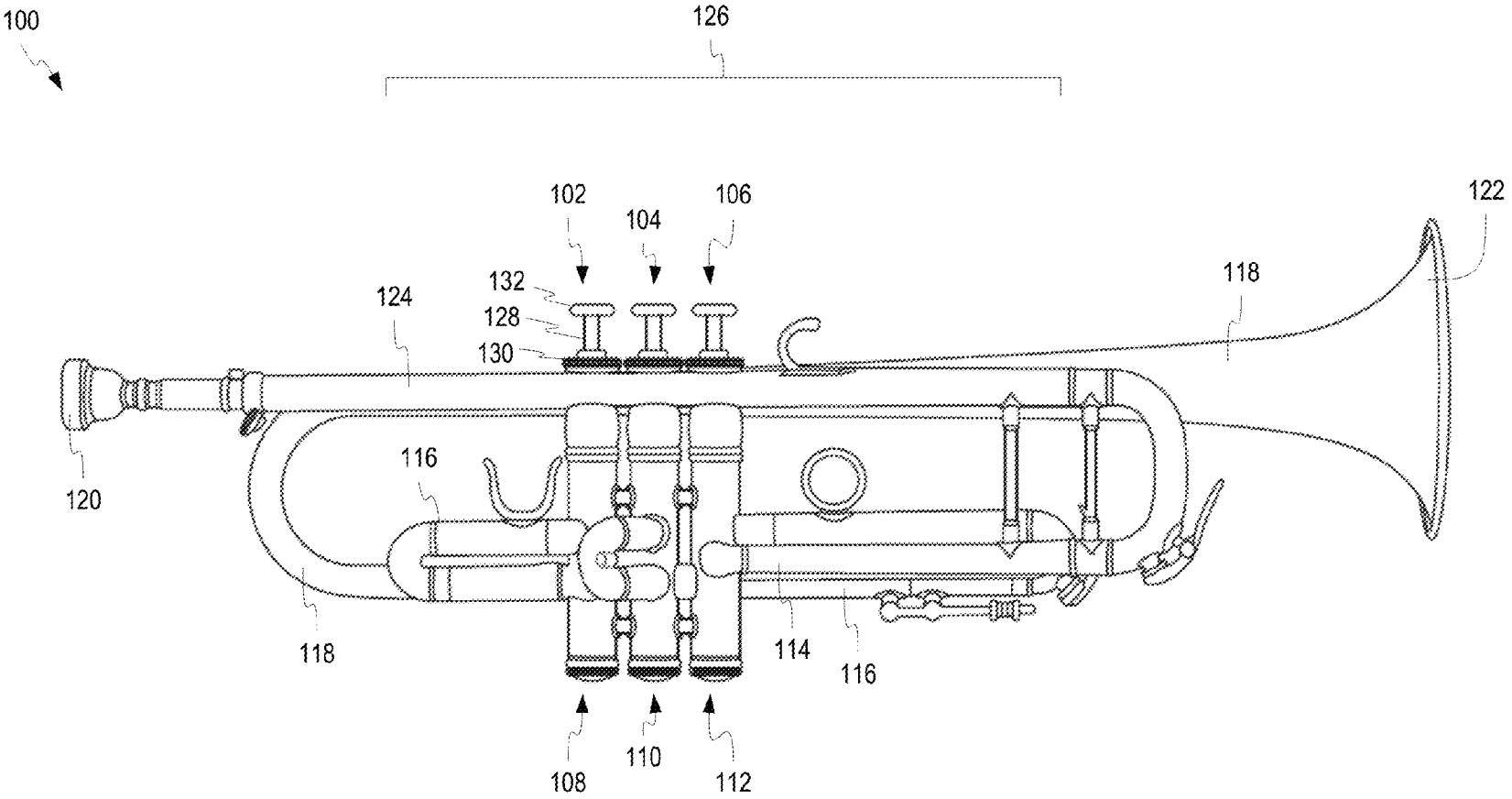
FIG. 1 is a side view of a trumpet having adjustable valves according to certain aspects of the present disclosure.

Certain aspects and features of the present disclosure relate to an adjustable valve for a musical instrument, such as a trumpet, that allows for adjustment of the valve alignment without removing the valve from the instrument. The adjustable valve is designed to fit and look like a standard valve. The valve can include a depressible actuator coupled to an adjustable valve stem. The adjustable valve stem can be fed through a top cap of the valve. The depressible actuator can be a finger button, a valve lever, a valve key, or any other suitable actuator. The depressible actuators described in the examples below are denoted as finger buttons, but any other suitable actuator can also be used. When depressed, the depressible actuator (e.g., finger button) axially displaces the adjustable stem, and thus the valve piston. The adjustable valve stem can be coupled to a valve piston, such as a valve piston of a standard valve. The adjustable valve stem can include a upper portion that is coupled to a lower portion by a threaded connection. The upper portion couples to an actuator (e.g., a finger button) and the lower portion couples to the valve piston. By turning the upper portion, such as by turning a finger button, the threaded connection increases or decreases the distance between a finger button and the lower portion of the adjustable valve stem because while the upper portion is able to rotate freely within the valve, the lower portion is securely coupled to the valve piston and does not rotate with rotation of the upper portion. Thus, alignment of the valve piston is achieved without removal of the valve from the instrument.

The upper portion and lower portion of the adjustable valve stem can be coupled together by a threaded connection or any other connection that allows controlled, axial movement of the upper portion with respect to the lower portion such that the distance between the first portion and the lower portion can be manipulated without removing the valve from the instrument and such that the distance between the upper portion and the lower portion will not change due to pressure applied from the spring mechanism in the valve piston. The upper portion and lower portion of the adjustable valve stem can be coupled together by any suitable axially-adjustable coupling. An axially-adjustable coupling can allow the upper portion and lower portion to move axially (e.g., along an axis directed into and out of a valve tube) with respect to one another. The axially-adjustable coupling specifically can allow the threaded cap of the lower portion to be axially displaced with respect to the stop plate of the upper portion. As described herein, the axially-adjustable coupling can be a threaded coupling, however any other suitable axially-adjustable coupling can be used.

A finger button can be coupled to the upper portion by a threaded connection or by any other suitable removable connection. A finger button can be coupled to the upper portion of the adjustable valve stem by a rotationally-fixed connection, allowing the finger button to be more easily used to turn the upper portion of the adjustable valve stem.

The upper portion and lower portion of the adjustable valve stem can be coupled through a coupling that provides a level of rotational resistance. The rotational resistance can help keep the upper portion and lower portion from rotating with respect to one another unless such rotation is specifically desired. Rotational resistance can be provided through the use of a friction bushing, such as a rubber o-ring, placed on a shaft of the lower portion that is threaded into a threaded region of the upper portion of the adjustable valve. The friction bushing can provide sufficient resistance to rotation of the upper portion with respect to the lower portion, such that the alignment of the adjustable valve would not change during standard play of the instrument (e.g., when the musician presses on a finger button), but that the alignment can be changed by intentional rotation of the upper portion of the adjustable valve stem. Additionally, the friction bushing can reduce and insulate any mechanical noise that would otherwise be caused by play or wiggling in the coupling between the upper portion and the lower portion.

The upper portion can include an internal bearing surface that interacts with a journal of the shaft of the lower portion to reduce play (e.g., wiggling) in the coupling between the upper portion and the lower portion. As described above, play in the coupling can create mechanical noise that would be unacceptable during a musical presentation, and therefore the combination of the journal and internal bearing surface and the use of a friction bushing can reduce this unwanted noise. The journal of the shaft can be a smooth portion of the shaft that is located distally from the threaded portion of the shaft. The internal bearing surface of the upper portion can be a smooth portion of a cavity of the upper portion. The smooth portion can be located proximally from the threaded portion of the cavity of the upper portion. The journal (e.g., smooth portion of the shaft of the lower portion) can abut and slide axially within the internal bearing surface (e.g., smooth portion of the cavity of the upper portion). The length of the journal and internal bearing surface can be sufficient to reduce play (e.g., wiggling) in the coupling between the upper portion and the lower portion. The outer diameter of the journal can be sufficiently smaller than the inner diameter of the internal bearing surface to allow rotational and axial movement without much resistance due to friction.

The upper portion and lower portion of the adjustable valve stem can be coupled through a threaded coupling. A threaded shaft of the lower portion can be threaded into a threaded portion of the upper portion of the adjustable valve stem. The threaded shaft and threaded portion can be reverse threaded (e.g., left-hand threaded) such that rotation of the finger button clockwise, as seen from above, will increase the overall length of the adjustable valve stem and adjust the piston to a lower alignment. Opposite rotation (e.g., counterclockwise as seen from above) will decrease the overall length of the adjustable valve stem and adjust the piston to a higher alignment. More specifically, rotation of the upper portion with respect to the lower portion will increase or decrease the distance between the stop plate of the upper portion, which engages the top cap, securing the valve into the valve tube, and the screw cap of the lower portion, which is coupled to the valve piston.

Guides can be included to provide an indication of the rotational position of the upper portion of the adjustable valve stem, and thus an indication of the alignment of the adjustable valve. Such guides can be visual, auditory, tactile, or any combination thereof. Examples of suitable guides include, but are not limited to, visual or tactile markings on the finger button, the adjustable valve stem, the top cap, or any combination thereof. Examples of other guides include non-visual guides, such as tactile guides that can be felt by a musician upon adjusting the adjustable valve stem or auditory guides that can be heard by a musician upon adjusting the adjustable valve stem.

The top cap can include a recess for a pad. The stop plate of the upper portion can engage the top cap by resting on the pad when the valve is in a non-actuated position (e.g., the finger button is not depressed). In some embodiments, a pad of a thickness less than that of a standard pad can be used in the top cap instead of a standard pad to allow for further alignment corrections in the upwards direction. The thinner pad can be approximately 2 millimeters or less. The thinner pad can be approximately 1 millimeter or less. The pad can be a washer-shaped pad (e.g., having a central hole through which the upper portion of the adjustable stem can pass). The pad can be positioned directly between a stop plate of the upper portion of the adjustable stem and the top cap of the valve.

The adjustable valve can be made of any suitable material, such as aluminum.

The adjustable valve can be especially useful with the second valve position, but can be used with any valve position. The adjustable valve can be used with any suitable valve-based instrument, such as a trumpet.

The adjustable valve can give a musician additional control over the instrument. A musician can control the backpressure experienced while playing the instrument, and can potentially regulate stamina (e.g., ability to produce the sound of longer musical passages without tiring or eventually failing to produce any sound at all) more efficiently. The amount of valve adjustment can be very small (e.g., around 0.050"). Valve adjustment can adjust how sound waves (e.g., which originate from the musician's vibrating lips) that travel through the instrument are reflected when they encounter the valve. When such reflections are strong, a musician may experience a sensation of the instrument "backing up" on him or her, and when such reflections are weak (e.g., in the case of an aligned valve), the musician may experience a sensation of the instrument "free blowing." As the valve moves out of alignment, additional reflecting surfaces (e.g., the walls of the valve piston itself) are presented to sound waves traveling through the instrument and air within the instrument. The presence and size of these additional reflecting surfaces can adjust the sound of the instrument as well as the feel of playing the instrument.

Additionally, adjustment to an adjustable valve can change an instrument's vibrational resistance, which can create advantages for a musician. Sound from air instruments, such as Brass instruments, is generated due to the instrument's resistance of energy introduced by a musician. The balance between the energy provided by a musician and the instrument's generation of sound can be altered by changing the instrument's resistance to vibrations, which can be accomplished through adjustment of an adjustable valve.

On-the-fly (e.g., in short gaps of time between passages of a single musical piece, between musical pieces, or even while playing) control of the alignment of the adjustable valve can enable a musician to provide unique or desirable control over the sound produced by the instrument. Such control can include correcting misalignment, as well as intentionally invoking misalignment to produce desired effects on the sound created by the instrument. Because this adjustment can occur on-the-fly, a musician can perform very precise experimentation with valve alignment and misalignment that could not have been accomplished otherwise. In other words, a musician can "dial in" the right setting without removing the valve from the instrument and even while playing the instrument. Furthermore, a musician can adjust the valve alignment discretely, without distracting an audience. A musician can make such adjustments discretely while performing, even between different moments of a single piece of music.

The adjustable valve can be produced as a replacement for a standard valve or included with an instrument. The adjustable valve stem itself can be produced to replace the non-adjustable valve stem in a standard valve. In some cases, a thin pad (e.g., with a thickness below 2 millimeters or below 1 millimeter) can be provided with the replacement adjustable valve stem in order to replace the standard pad used under the top cap.

The adjustable valve can include a locking mechanism to lock adjustment of the adjustable stem. The locking mechanism can be a mechanism cooperating between the upper portion and lower portion of the adjustable stem. The locking mechanism can be a mechanism cooperating between the upper portion and the valve tube or top cap. The locking mechanism can be an additional mechanism positioned external the valve tube and cooperating with the finger button or upper portion of the adjustable valve. The locking mechanism can be any suitable mechanism for rotationally locking the upper portion with respect to the lower portion of the adjustable stem.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

FIG. 1 is a side view of a trumpet 100 having adjustable valves 102, 104, 106 according to certain aspects of the present disclosure. While shown as a trumpet 100, adjustable valves can be used with any suitable valve-based musical instrument, such as tubas, euphoniums, horns, comets, and others. The trumpet 100 generally includes a mouthpiece 120 coupled to a bell 122 through tubing path 124.

The tubing path 124 includes a first main path 114, a valve region 126, and a second main path 118. The valve region 126 includes valve tubes 108, 110, 112 in which adjustable valves 102, 104, 106 are placed, as well as crooks 116. The valve region 126 allows for the length of the tubing path 124 to be changed by actuating an adjustable valve 102, 104, 106, which changes the fundamental pitch of the trumpet 100. Depressing an adjustable valve 102, 104, 106 causes air traveling through the first main path 114 from the mouthpiece 120 to be routed through a crook 116 before continuing through to the second main path 118 to the bell 122. When the valve is not depressed, air would continue straight from the first main path 114, through the adjustable valve 102, 104, 106, and out to the second main path 118 to the bell 122.

Each adjustable valve 102, 104, 106 can be actuated by depressing a respective finger button 132 of the adjustable valve 102, 104, 106. In each adjustable valve 102, 104, 106, the finger button 132 is coupled to a valve piston by an adjustable valve stem 128. The adjustable valve stem 128 passes through a top cap 130, which secures the adjustable valve 102, 104, 106 in the valve tube 108, 110, 112. Each valve piston includes valve openings that connect to pathways in the valve tube 108, 110, 112. The pathways in the valve tube 108, 110, 112 are openings that lead to the tubing path 124, such as to other parts of the valve region 126 (e.g., adjacent valve tubes 108, 110, 112, or crooks 116), the first main path 114, or the second main path 118. The valve openings of the piston fluidly connect two pathways together, allowing air to pass through. For example, in a non-actuated state, an adjustable valve 102, 104, 106 can have its respective valve piston positioned such that its valve openings are aligned with the pathways that allow air to flow from the first main path 114, through adjacent valve tubes 108, 110, 112, and out the second main path 118, without going through a crook 116 associated with the valve piston. However, in an actuated state, the valve piston can be positioned in its valve such that its valve openings are aligned with the pathways that allow air to flow through a crook 116 before continuing to the second main path 118.

Each piston can include multiple valve openings (e.g., four valve openings). Within a valve piston, two valve openings can be connected by a passageway, such that air flowing through a pathway of the trumpet 100 can enter the valve piston through a valve opening, pass through the passageway of the valve piston and out a second valve opening, then passing out through a second pathway of the trumpet 100.

As described above, valve alignment is important for many reasons. Valve alignment can include adjusting the displacement between the center of a valve opening and the center of a respective pathway. When a valve is aligned, the valve opening and its respective pathway may be concentric. When a valve is not aligned, the valve opening and its respective pathway may be not concentric.

The adjustable valves 102, 104, 106 can enable adjustment of valve alignment through rotation of a finger button 132. Adjustment of the valve alignment can occur without removing the adjustable valve 102, 104, 106 from its respective valve tube 108, 110, 112. Rotation of the finger button 132 can change the overall length of the adjustable valve stem 128, thus axially displacing the valve piston so that its valve opening becomes more or less concentric with a respective pathway.

Figure 2:
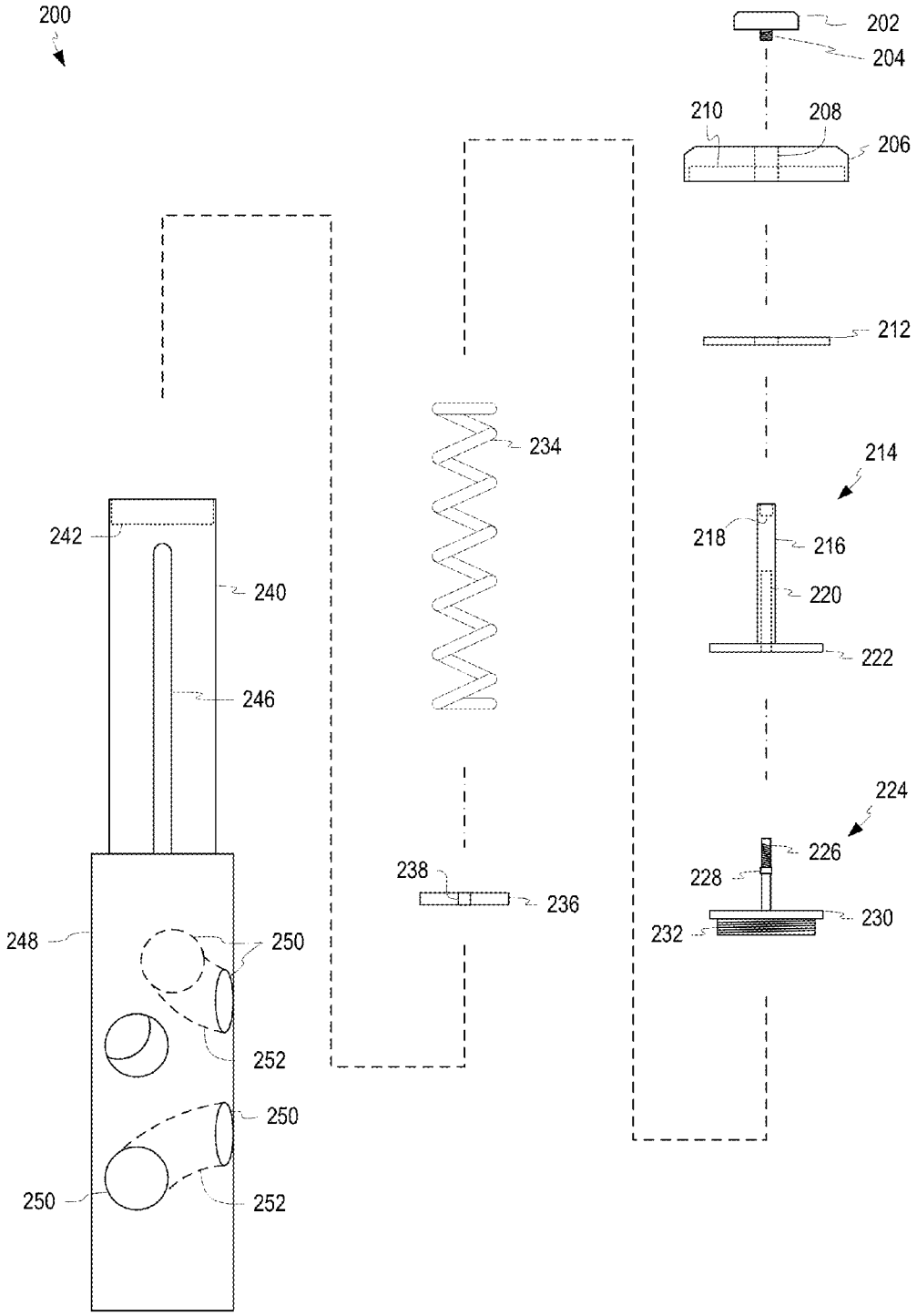
FIG. 2 is an exploded side view of an adjustable valve according to certain aspects of the present disclosure.

FIG. 2 is an exploded side view of an adjustable valve 200 according to certain aspects of the present disclosure. The adjustable valve 200 can include a valve piston 248, a return spring 234, a lower portion 224 of an adjustable stem, an upper portion 214 of an adjustable stem, a top cap 206, and a finger button 202.

The finger button 202 is coupled to the upper portion 214. The finger button 202 can include a threaded shaft 204 that can couple via threading to a threaded recess 218 of the upper portion 214. The threaded coupling between the finger button 202 and the upper portion 214 can be sufficiently secure to allow for rotation of the finger button 202 in both a clockwise and counter-clockwise direction to translate to rotation of the upper portion 214 in a clockwise and counter-clockwise direction, respectively, without decoupling (e.g., unscrewing) of the finger button 202. The finger button 202 can be coupled to the upper portion 214 in other ways, such as by a snap coupling. The finger button 202 can be rotationally fixed with respect to the upper portion 214, such as through a spline coupling or other suitable rotationally-fixed coupling.

The top cap 206 includes an aperture 208 through which the threaded shaft 204 can pass. The top cap 206 includes a recess 210 into which a pad 212 can be placed. The pad 212 can be a thin pad that is thinner than a standard pad. The pad 212 can have a thickness of 2 millimeters or less. The pad 212 can have a thickness of 1 millimeter or less. The pad 212 includes an aperture through which the threaded shaft 204 can pass. The recess 210 of the top cap 206 also includes threads that engage the valve tube of the instrument to secure the adjustable valve 200 into the valve tube of the instrument.

The upper portion 214 of the adjustable stem includes a shaft 216 with a threaded recess 218 for coupling to the finger button 202. As described above, the finger button 202 can be coupled to the shaft 216 in other ways besides a threaded coupling. The shaft 216 includes a cavity 220 for coupling the upper portion 214 to the lower portion 224. The upper portion 214 includes a stop plate 222. The stop plate 222 can rest against the pad 212 when the adjustable valve 200 is not actuated (e.g., the finger button 202 is not depressed).

The shaft 216 of the upper portion 214 can have an outer diameter that can fit within the aperture 208 of the top cap 206. The shaft 216 can have an outer diameter sized to fit within the aperture 208 of a standard top cap. The shaft 216 can have an outer diameter that is smaller than one-quarter-inch. The shaft 216 can have an outer diameter that is smaller than three sixteenths of an inch. The cavity 220 of the shaft 216 and the shaft 226 of the lower portion 224 can be sized appropriately according to the size of the shaft 216.

The lower portion 224 of the adjustable stem includes a shaft 226 and a screw cap 230. The screw cap 230 includes threads 232 that engage a threaded recess 242 of the valve piston 248. The shaft 226 includes threads that engage threads within the cavity 220 of the upper portion 214, such that rotation of the upper portion 214 with respect to the lower portion 224 axially moves the lower portion 224 with respect to the upper portion 214 (e.g., by "screwing in" or "screwing out" the lower portion 224 with respect to the upper portion 214). A bushing 228 can be located on the shaft 226 to provide rotational resistance between the upper portion 214 and the lower portion 224. The rotational resistance can protect against inadvertent rotation of the upper portion 214 with respect to the lower portion 224, ensuring only deliberate rotation of the finger button 202 translates to axial movement of the lower portion 224 with respect to the upper portion 214.

A return spring 234 and a piston guide 236 can be positioned within a guide tube 240 of the valve piston 248. The piston guide 236 can include guide tabs 238 that extend past slots 246 in the guide tube 240. When threads 232 of the screw cap 230 are threaded into the threaded recess 242 of the guide tube, the return spring 234 can bias the piston guide 236 away from the screw cap 230 of the lower portion 224. The guide tabs 238 that extend past slots 246 can engage slots in the valve tube of the instrument.

The guide tube 240 is fixed to the valve piston 248. The valve piston 248 includes valve openings 250. Passageways 252 connect corresponding valve openings 250 together. In an adjustable valve 200 used in a trumpet, the valve piston 248 can include six valve openings 250 and three passageways 252.

When the finger button 202 is pressed, axial displacement of the finger button 202 causes the upper portion 214 and lower portion 224 of the adjustable stem to be axially displaced, which in turn causes the guide tube 240 and valve piston 248 to be axially displaced, thus axially displacing the valve openings 250 within the valve tube. When the finger button 202 is pressed, the movement of the screw cap 230 compresses the return spring 234 against the piston guide 236, which cannot be displaced further into the valve tube because the guide tabs 238 engage slots in the valve tube of the instrument. Thus, when the finger button 202 is released, the return spring 234 biases the screw cap 230, and thus the entire adjustable stem, guide tube 240, valve piston 248, and finger button 202, back to a released position.

Figure 3:
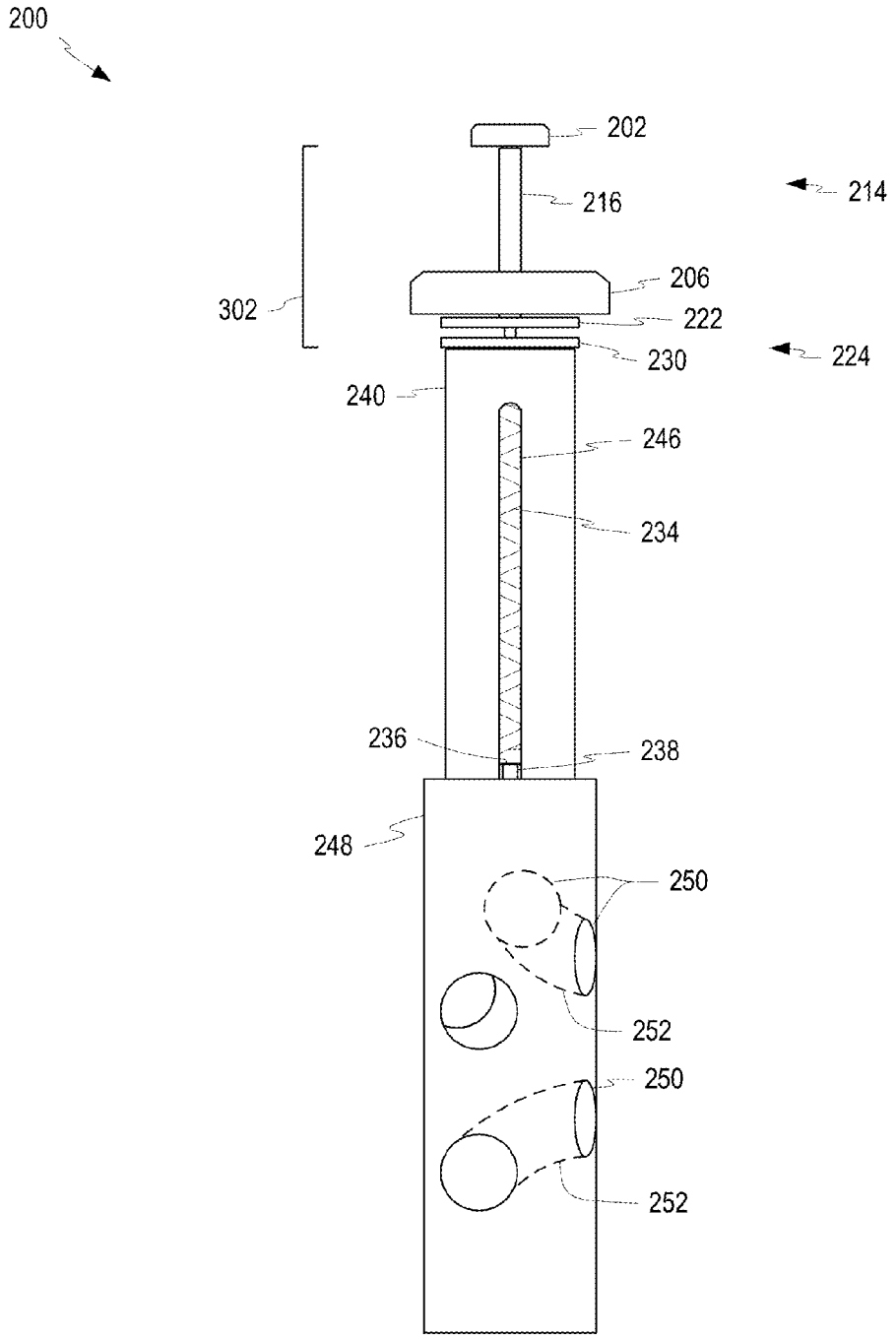
FIG. 3 is a side view of the adjustable valve of FIG. 2 according to certain aspects of the present disclosure.

FIG. 3 is a side view of the adjustable valve 200 of FIG. 2 according to certain aspects of the present disclosure. The adjustable valve 200 includes the top cap 202 coupled to the shaft 216 of the upper portion 214. The shaft 216 of the upper portion 214 extends through the top cap 206. The upper portion 214 is coupled to the lower portion 224, which together make up the adjustable valve stem 302. The upper portion 214 includes a stop plate 222 which engages the top cap 206 when the adjustable valve 200 is inserted into a valve tube of an instrument and the top cap 206 is screwed onto the valve tube. The screw cap 230 of the lower portion 224 is coupled to the guide tube 240. The return spring 234 is positioned within the guide tube 240, between the screw cap 230 and the piston guide 236. The guide tabs 238 of the piston guide 236 extend through the slots 246 in the guide tube 240. The guide tube 240 is fixed to the valve piston 248, which includes valve openings 250 and passageways 252.

Figure 4:
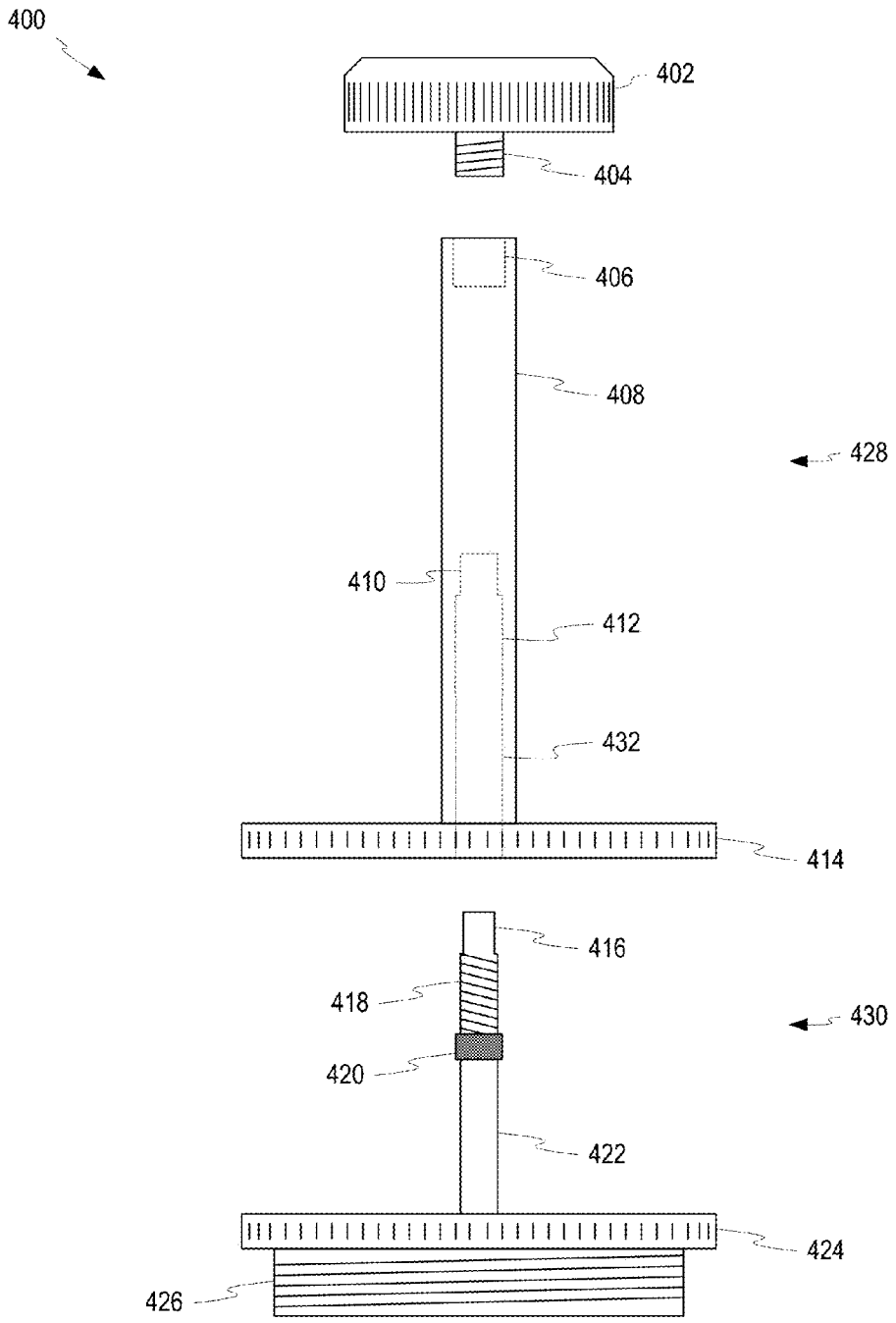
FIG. 4 is a side view of an adjustable stem according to certain aspects of the present disclosure.

FIG. 4 is a side view of an adjustable stem 400 and a finger button 402 according to certain aspects of the present disclosure. The finger button 402 can have a knurled circumference or other features to increase grip. The finger button 402 can include a threaded shaft 404. The upper portion 428 of the adjustable stem 400 includes a shaft 408 having a stop plate 414. The shaft 408 includes a threaded recess 406 into which the threaded shaft 404 of the finger button 402 can be threaded.

The shaft 408 includes a cavity 432 opposite the end of the shaft 408 where the finger button 402 couples to the shaft 408. The cavity 432 can include a threaded portion 412 and a linear bearing portion 410. The linear bearing portion 410 can be located proximally (e.g., towards the finger button) from the threaded portion 412. The threaded portion 412 corresponds to a threaded portion 418 of the shaft 422 of the lower portion 430 of the adjustable stem 400.

The shaft 422 of the lower portion 430 can include a threaded portion 418 and a journal 416. The journal 416 can be a smooth portion of the shaft 422 that is sized to slide freely within the linear bearing portion 410 of the upper portion 428. The journal 416 can have an outer diameter that is approximately equal to, but slightly smaller, than the inner diameter of the linear bearing portion 410. The journal 416 can be located distally from the threaded portion 418 (e.g., toward the end of the shaft 422). The journal 416 can have an outer diameter that is smaller than the threaded portion 418.

In an alternate embodiment, the journal 416 can be located proximally from the threaded portion 418 and the linear bearing portion 410 can be located distally from the threaded portion 412. In such an embodiment, the journal 416 can have an outer diameter larger than the threaded portion 418. In an alternate embodiment, the shaft 422 has no journal 416 and the shaft 408 has no linear bearing portion 410.

A bushing 420 can be located on the shaft 422 to provide rotational resistance to the lower portion 430 with respect to the upper portion 428. The bushing 420 can be rubber or any other suitable material.

The lower portion 430 can include a screw cap 424 having a threaded portion 426.

Figure 5:
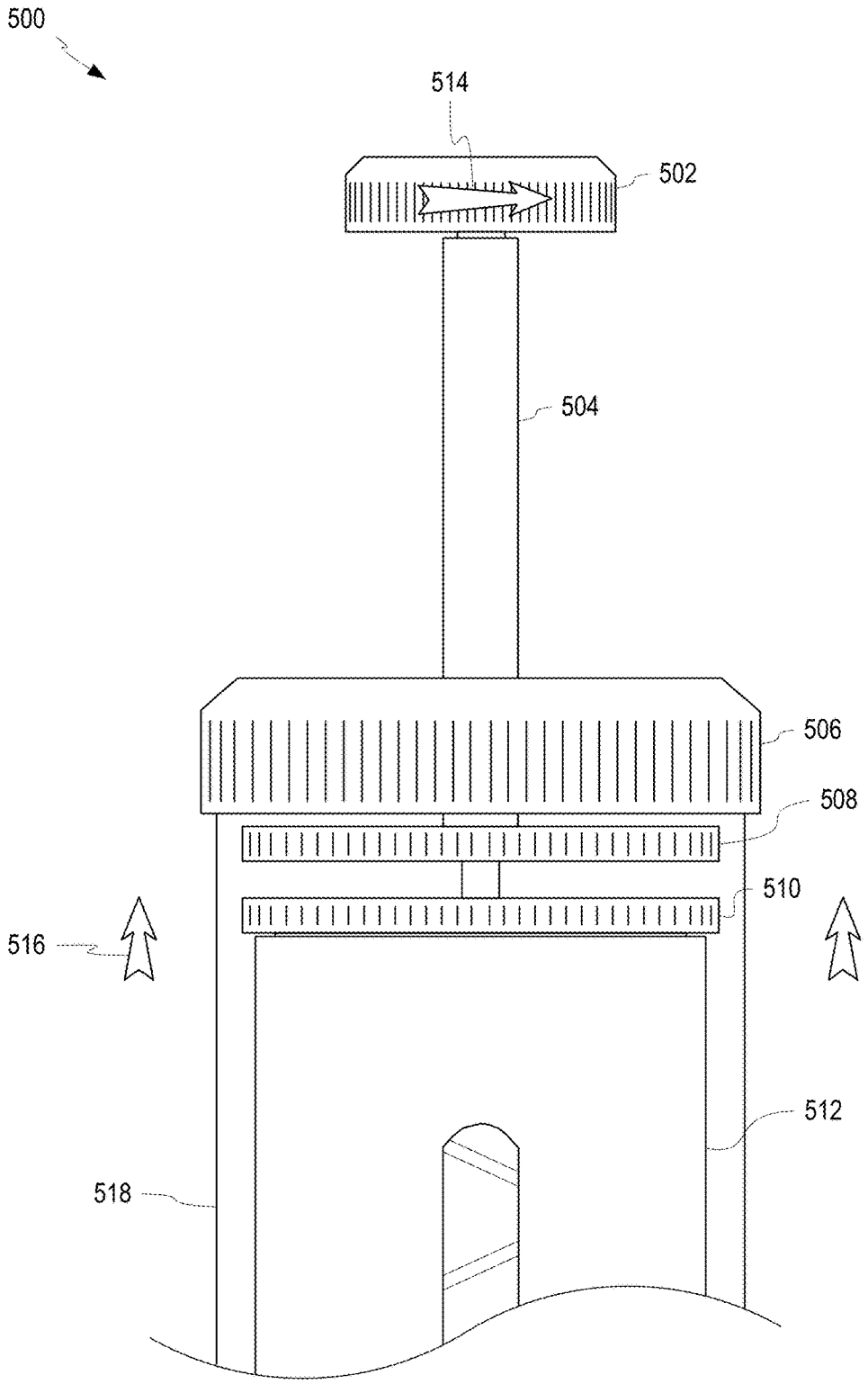
FIG. 5 is a partial side view of an adjustable valve in a first position according to certain aspects of the present disclosure.

FIG. 5 is a partial side view of an adjustable valve 500 in a first position according to certain aspects of the present disclosure. In the first position, the finger button 502 has been rotated in a counter-clockwise direction 514 (e.g., counter-clockwise when viewed from above). Rotation of the finger button 502 induced rotation of the shaft 504 of the upper portion. The lower portion is held rotationally fixed with respect to the valve piston, which is held rotationally fixed with respect to the valve tube 518 due to the guide tabs that extend through the guide tube 512. Rotation of the shaft 504 of the upper portion in a counter-clockwise direction causes the screw cap 510 to move in an upwards direction 516, towards the stop plate 508 (e.g., reducing the distance between the screw cap 510 and the stop plate 508). As the screw cap 510 moves upwards, the guide tube 512 coupled to the screw cap 510 moves upwards, along with the valve piston and the openings in the valve piston. The extent to which the valve piston moves upwards as the finger button 502 is rotated depends on the pitch of the threaded coupling between the upper portion and lower portion of the adjustable stem. In the first position, the valve piston has been raised to a heightened position.

Figure 6:
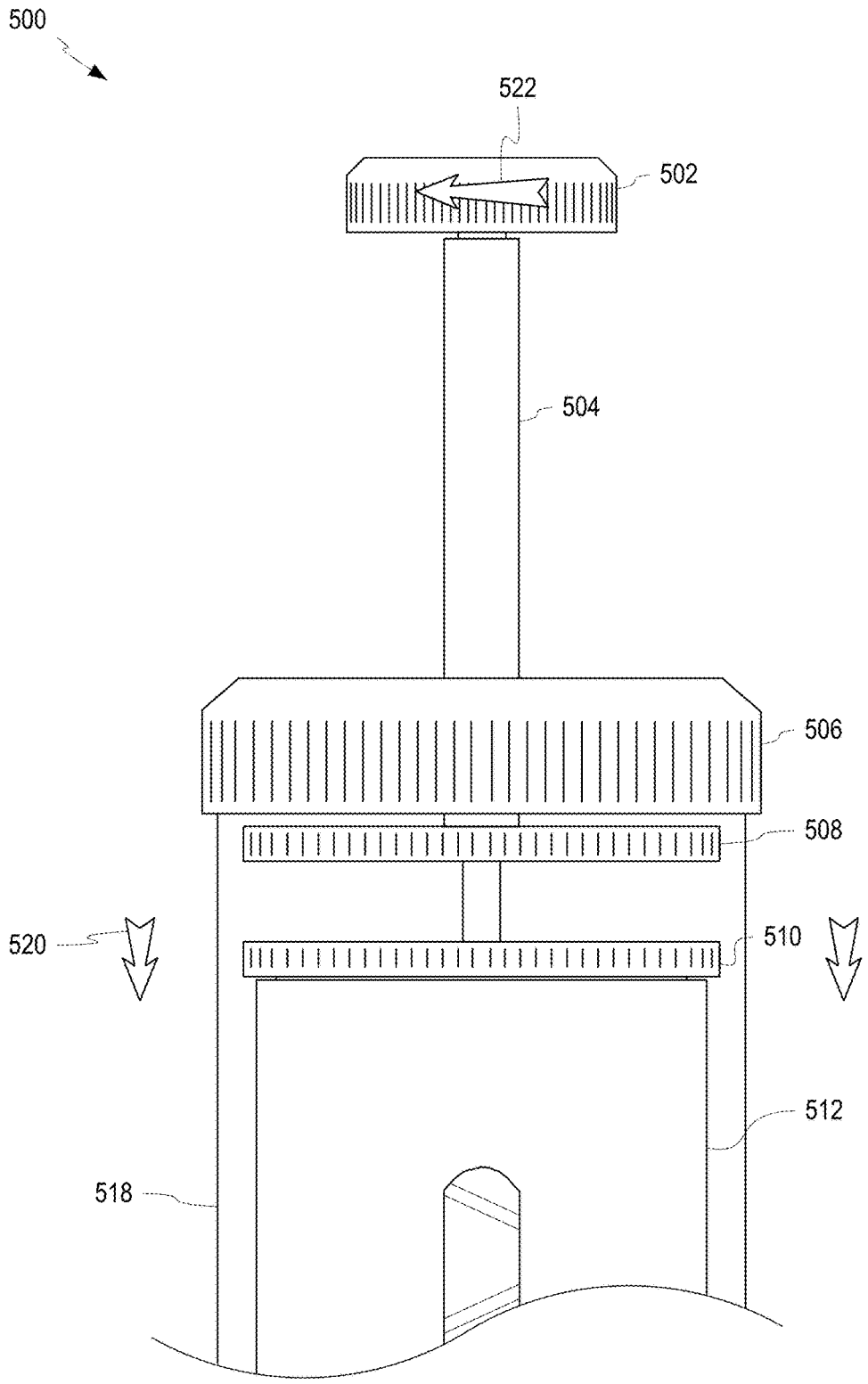
FIG. 6 is a partial side view of the adjustable valve of FIG. 5 in a second position according to certain aspects of the present disclosure.

FIG. 6 is a partial side view of the adjustable valve 500 of FIG. 5 in a second position according to certain aspects of the present disclosure. In the second position, the finger button 502 has been rotated in a clockwise direction 522 (e.g., clockwise when viewed from above). Rotation of the finger button 502 induced rotation of the shaft 504 of the upper portion. Rotation of the shaft 504 of the upper portion in a clockwise direction causes the screw cap 510 to move in an downwards direction 520, away from the stop plate 508 (e.g., increasing the distance between the screw cap 510 and the stop plate 508). As the screw cap 510 moves downwards, the guide tube 512 coupled to the screw cap 510 moves downwards, along with the valve piston and the openings in the valve piston. The extent to which the valve piston moves downwards as the finger button 502 is rotated depends on the pitch of the threaded coupling between the upper portion and lower portion of the adjustable stem. In the second position, the valve piston has been lowered to a lowered position.

Figure 7:
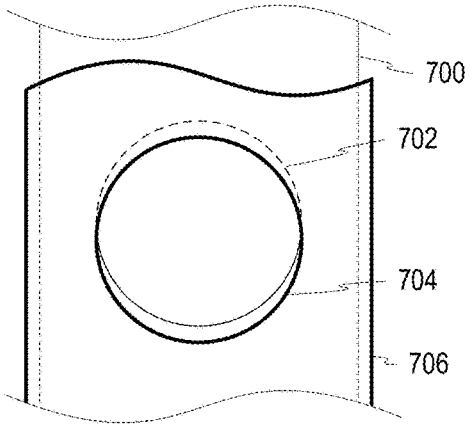
FIG. 7 is a partial cut-away side view of a valve piston of the adjustable valve of FIG. 5 in the first position according to certain aspects of the present disclosure.

FIG. 7 is a partial cut-away side view of a valve piston 700 of the adjustable valve 500 of FIG. 5 in the first position according to certain aspects of the present disclosure. The valve piston 700 can be seen through the valve tube 706. A pathway 704 in the valve tube 706 is seen. The pathway 704 can lead to any tubing within the instrument, such as main tubing or a crook. The valve opening 702 of the valve piston 700 is not concentric with the pathway 704 (e.g., the center of the valve opening 702 is displaced from the center of the pathway 704).

When the adjustable valve 500 is in the first position, the center of the valve opening 702 is displaced upwards (e.g., towards the finger button) of the center of the pathway 704.

Figure 8:
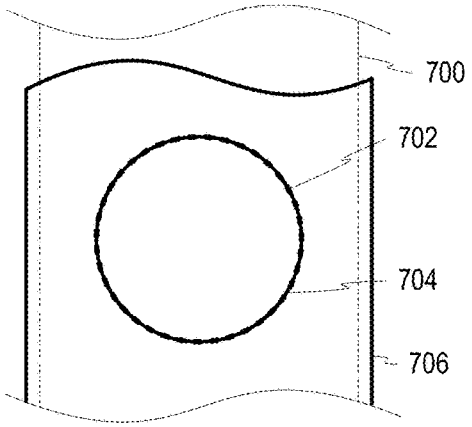
FIG. 8 is a partial cut-away side view of the valve piston of FIG. 7 in an aligned position according to certain aspects of the present disclosure.

FIG. 8 is a partial cut-away side view of the valve piston 700 of FIG. 7 in an aligned position according to certain aspects of the present disclosure. The valve piston 700 can be seen through the valve tube 706. A pathway 704 in the valve tube 706 is seen. The pathway 704 can lead to any tubing within the instrument, such as main tubing or a crook. The valve opening 702 of the valve piston 700 is concentric with the pathway 704 (e.g., the center of the valve opening 702 is in line with the center of the pathway 704).

When the adjustable valve 500 is in an aligned position, the center of the valve opening 702 is in line with the center of the pathway 704.

Figure 9:
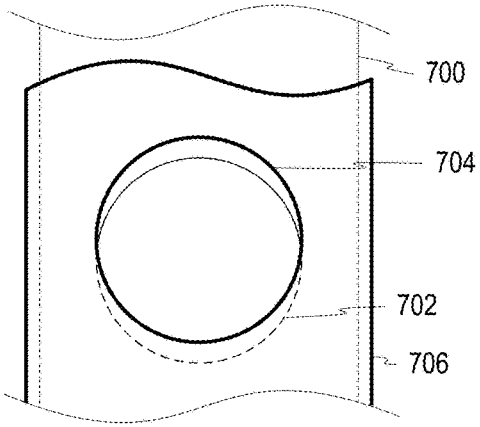
FIG. 9 is a partial cut-away side view of the valve piston of FIG. 7 in the first position according to certain aspects of the present disclosure.

FIG. 9 is a partial cut-away side view of the valve piston 700 of FIG. 7 in the first position according to certain aspects of the present disclosure. The valve piston 700 can be seen through the valve tube 706. A pathway 704 in the valve tube 706 is seen. The pathway 704 can lead to any tubing within the instrument, such as main tubing or a crook. The valve opening 702 of the valve piston 700 is not concentric with the pathway 704 (e.g., the center of the valve opening 702 is displaced from the center of the pathway 704).

When the adjustable valve 500 is in the second position, the center of the valve opening 702 is displaced downwards (e.g., away from the finger button) of the center of the pathway 704.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

What is claimed is:

1. A trumpet valve, comprising:

a piston positionable within a valve tube of an instrument, the piston having at least one passageway for directing fluid through the piston; and an adjustable stem coupling the piston to a depressible actuator, the adjustable stem including an upper portion coupled to a lower portion by an axially-adjustable coupling, wherein the axially-adjustable coupling is adjustable to control an alignment of the piston within the valve tube by changing a length of the adjustable stem.

2. The valve of claim 1, wherein the axially-adjustable coupling is a threaded coupling, and wherein the upper portion is coupled to the lower portion to adjust an axial distance between the upper portion and the lower portion when the upper portion is rotated with respect to the lower portion.

3. The valve of claim 2, wherein the threaded coupling is threaded oppositely from at least one of a second threaded coupling between the depressible actuator and the adjustable stem and a third threaded coupling between the adjustable stem and the piston.

4. The valve of claim 2, wherein the adjustable stem further includes a friction bushing for providing rotational resistance to the threaded coupling.

5. The valve of claim 2, wherein the upper portion includes an internal linear bearing surface that interacts with a journal of the lower portion.

6. The valve of claim 1, wherein the depressible actuator is rotationally fixed to the upper portion of the adjustable stem.

7. The valve of claim 1, further comprising a pad positionable directly between a stop plate of the upper portion and a top cap, the pad having a thickness that is less than 2 millimeters.

8. An assembly, comprising:

an adjustable stem couplable between a depressible actuator and a valve piston, the adjustable stem including:

an upper portion having a first end couplable to the depressible actuator and a second end including a stop plate and a cavity; and a lower portion having a shaft coupled to the second end of the upper portion by an axially-adjustable coupling, wherein the lower portion is couplable to the valve piston, and wherein the axially-adjustable coupling is adjustable to control an alignment of the valve piston within a valve tube by changing a length of the adjustable stem.

9. The assembly of claim 8, wherein the axially-adjustable coupling is a threaded coupling including a threaded portion of the cavity and a threaded portion of the shaft.

10. The assembly of claim 9, wherein the threaded coupling is threaded oppositely from at least one of a second threaded coupling between the depressible actuator and the adjustable stem and a third threaded coupling between the adjustable stem and the valve piston.

11. The assembly of claim 9, wherein the adjustable stem further includes a friction bushing positioned on the shaft for providing rotational resistance to the threaded coupling.

12. The assembly of claim 9, wherein the cavity includes an internal linear bearing surface that interacts with a journal of the shaft.

13. The assembly of claim 8, wherein the first end of the upper portion is couplable to the depressible actuator by a rotationally fixed coupling.

14. The assembly of claim 8, further comprising a pad positionable directly between the stop plate of the upper portion and a top cap of a valve, wherein the pad has a thickness less than 2 millimeters.

15. A method, comprising:

providing a valve within a valve tube of a musical instrument, the valve including a valve opening corresponding to a pathway of the musical instrument;

rotating a depressible actuator coupled to an adjustable stem; and adjusting a length of the adjustable stem when the depressible actuator is rotated, wherein adjusting the length of the adjustable stem controls an alignment of the valve within the valve tube.

16. The method of claim 15, wherein controlling alignment of the valve includes changing a displacement between a center of the valve opening and a center of the pathway.

17. The method of claim 15, wherein providing the valve includes:

removing a standard valve from the valve tube; and inserting the valve in the valve tube.

18. The method of claim 15, wherein providing the valve includes replacing a nonadjustable stem in an existing valve with the adjustable stem.

19. The method of claim 15, wherein adjusting the length of the adjustable stem includes:

rotating an upper portion of the adjustable stem with respect to a lower portion of the adjustable stem when the depressible actuator is rotated, wherein the upper portion is coupled to the lower portion by a threaded coupling; and axially displacing the lower portion with respect to the upper portion when the upper portion is rotated with respect to the lower portion.

20. The method of claim 19, wherein adjusting a length of the adjustable stem to control the alignment of the valve occurs when the depressible actuator is rotated without removal of the valve from the valve tube.

* * * * *